US008378262B2

(12) United States Patent
Wei et al.

(10) Patent No.: US 8,378,262 B2
(45) Date of Patent: Feb. 19, 2013

(54) DEFOGGING DEVICE WITH CARBON NANOTUBE FILM

(75) Inventors: Chao-Tsang Wei, Taipei Hsien (TW); Ga-Lane Chen, Santa Clara, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 338 days.

(21) Appl. No.: 12/843,058

(22) Filed: Jul. 26, 2010

(65) Prior Publication Data

US 2011/0024408 A1 Feb. 3, 2011

(30) Foreign Application Priority Data

Jul. 31, 2009 (CN) ..... 2009 1 0305033

(51) Int. Cl.
*H05B 3/84* (2006.01)

(52) U.S. Cl. ..... 219/203; 219/219; 219/268; 219/509; 977/742

(58) Field of Classification Search ..... 219/260, 219/263, 268
See application file for complete search history.

(56) References Cited

U.S. PATENT DOCUMENTS

| | | | | |
|---|---|---|---|---|
| 2008/0203078 | A1* | 8/2008 | Huerter | 219/203 |
| 2009/0085461 | A1 | 4/2009 | Feng et al. | |
| 2010/0140259 | A1* | 6/2010 | Feng et al. | 219/546 |
| 2010/0206504 | A1* | 8/2010 | Akiyama et al. | 162/181.9 |

FOREIGN PATENT DOCUMENTS

| | | | |
|---|---|---|---|
| CN | 101400198 | A | 4/2009 |
| WO | 2009054415 | A1 | 4/2009 |

* cited by examiner

*Primary Examiner* — Stephen W Smoot
(74) *Attorney, Agent, or Firm* — Altis Law Group, Inc.

(57) ABSTRACT

A defogging device for reducing fog on a surface of a substrate, which comprises a power unit and a heating element. The heating element is attached to the substrate, which comprises at least one carbon nanotube film comprising carbon nanotubes arranged substantially parallel to each other. The heating element transforms electricity into heat to vaporize fog of the first surface of the substrate when the heating element is connected to the power unit.

19 Claims, 3 Drawing Sheets

DEFOGGING DEVICE WITH CARBON NANOTUBE FILM

BACKGROUND

1. Technical Field

The present disclosure relates to defogging, and particularly, to a defogging device with a carbon nanotube film.

2. Description of Related Art

Carbon nanotubes have received a great deal of interest since the early 1990s due to their useful mechanical and electrical properties. Carbon nanotubes have become a significant focus of research and development for use in electron emitting devices, sensors, and transistors. Carbon nanotubes are allotropes of graphite and diamond, and can be classified into single-walled nanotubes (SWNTs) and multi-walled nanotubes (MWNTs).

Titanium dioxide (TiO2) photocatalyst is commonly used in conventional defogging applications, often being applied to a surface by spraying and naturally dried. When the photocatalyst is exposed to ultraviolet radiation, directly or reflectively, dirt or contaminants are decomposed and removed from the surface of the glass to prevent fogging.

However, spraying of titanium dioxide photocatalyst powder may be harmful to operators of the spraying process. Therefore, professional equipment and operators are needed during the spraying process of titanium dioxide photocatalyst powder, which results manufacturing high costs. Furthermore, in the absence of UV radiation, titanium dioxide photocatalyst provides ineffective defog capability.

What is needed, therefore, is an improved defogging device to reduce or overcome the aforementioned problems.

DETAILED DESCRIPTION

References will now be made to the drawings to describe, in detail, embodiments of the present carbon nanotube film defogging device.

Figure 1:
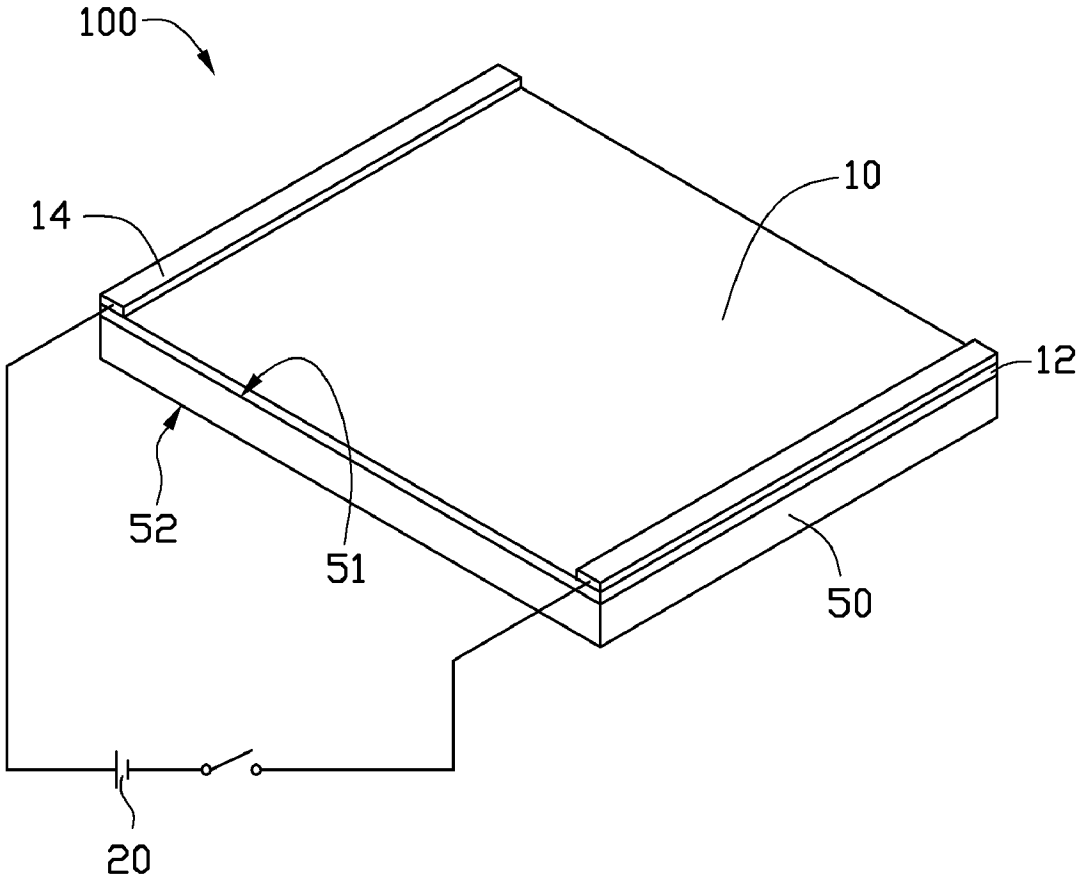
FIG. 1 is a schematic view of one embodiment of a defogging device with carbon nanotube films.

Referring to FIG. 1, one embodiment of a carbon nanotube film defogging device 100 comprises a heating element 10 and a power unit 20, to substantially reduce fog on a surface of a substrate 50. The substrate 50 comprises a first surface 51 and a second surface 52, arranged opposite to each other.

The heating element 10 is configured to be attached to the first surface 51, the second surface 52, or to both. In this embodiment, the heating element 10 is attached to the first surface 51 of the substrate 50.

In this embodiment, the heating element 10 comprises a carbon nanotube film 12, comprising a plurality of carbon nanotubes arranged substantially parallel to each another. The nanotube film 12 can be composed of single-walled carbon nanotubes, or multi-walled carbon nanotubes. In this embodiment, the carbon nanotube film 12 is composed of single-walled carbon nanotubes, arranged on the same plane. For improved electrical conductivity and heat dissipation, it is preferable to stretch super-aligned carbon nanotube arrays to form the carbon nanotube film 12.

China Patent No. 02134760.3 provides a growing method of super-aligned nanotube arrays, which comprises providing a plain substrate, depositing a catalyzer layer, annealing the substrate in a temperature range of 300° C. to 500° C. in a protection gas for 10 hours, heating the substrate to 500° C. to 700° C., introducing a carbon source gas, preferably acetylene, and acting for 5 to 30 minutes. Carbon nanotubes of the carbon nanotube array grown by the foregoing method are formed in bundles arranged highly concentrated, with more uniform diameters than those made by conventional means.

In one example, the carbon nanotube film 12 can be formed from the array of carbon nanotubes by the following method. A plurality of nanotube segments are selected, and is stretched by a tool, such as a tweezer. During the stretching process, the nanotube segments are joined end to end by Van der Waals forces therebetween along the direction of stretching, and a plurality of nanotube strings is formed. After repeated stretching, the nanotube strings combine to form the nanotube film 12.

Because of pure nanotube construction, the nanotube film 12 provides optimal mechanical strength, high efficiency of power transformation, (such as efficient conversion of electrical energy to heat energy), and high light transmittance.

The heating element 10 can be cut into different sizes to fit the shape and size of the substrate 50. For example, the substrate 50 can be a rearview mirror, a car window, a mirror in a bathroom, a lens of a camera or any number of optical devices. After being cut, the heating element 10 can be attached to a surface of the substrate 50 by an adhesive. The adhesive can be applied on the periphery of the heating element 10, allowing the carbon nanotube film 12 to attach to the substrate 50 directly, and heat conductance of the heating element 10 can be increased up to 95%.

Two ends of the heating element 10 are connected to the anode and the cathode of a power unit 20 separately. After the connection, the carbon nanotube film 12 transforms electricity to heat to substantially reduce fog of the first surface of the substrate 50. Alternatively, metal electrodes 14 can be formed on two ends of the heating element 10, to connect the heating element 10 to the power unit 20.

Figure 2:
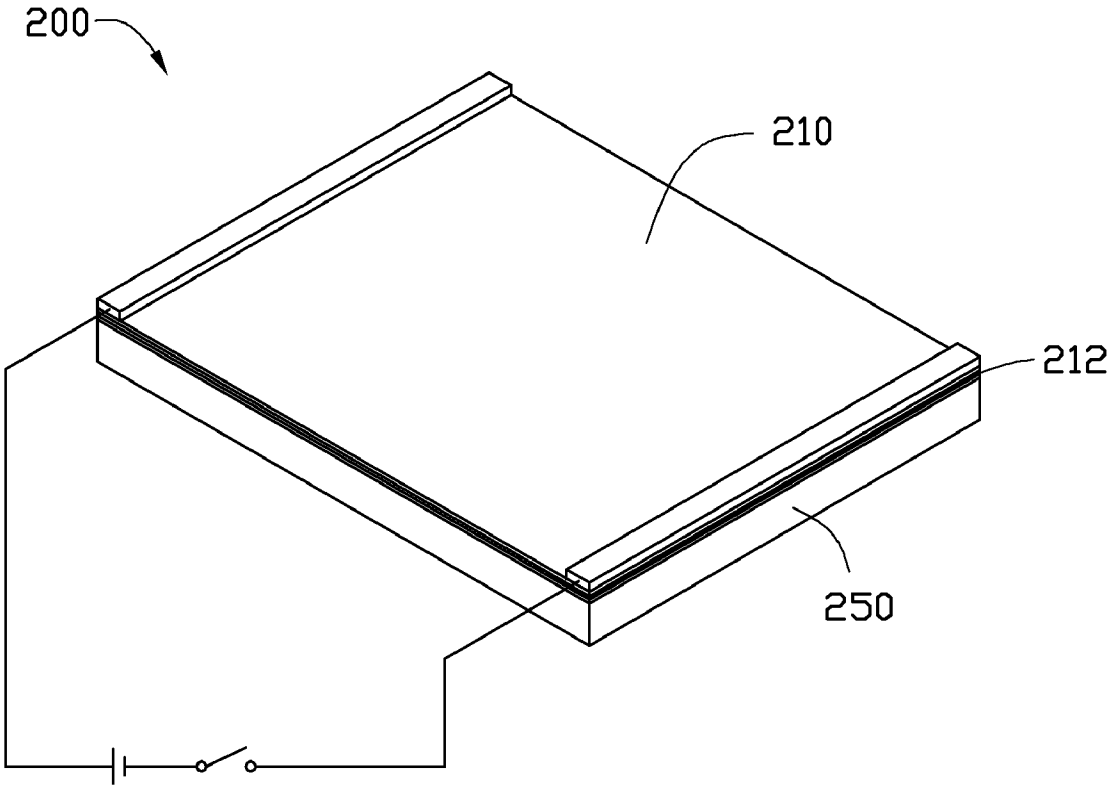
FIG. 2 is a schematic view of a second embodiment of a defogging device with carbon nanotube films.

FIG. 2 shows a second embodiment of the present application, providing a carbon nanotube film defogging device 200, differing from the first embodiment in that the heating element 10 is replaced by a heating element 210, which includes a multi-layer carbon nanotube film 212. The multi-layer carbon nanotube film 212 can be formed by stacking two or more carbon nanotube films along a substantially same direction. The carbon nanotubes in two adjacent carbon nanotube films of the multi-layer carbon nanotube film 212 can be arranged along one direction, two directions which are perpendicular to each other, or two directions forming an angle. The multi-layer carbon nanotube film 212 has a greater thickness and increased deformation than the carbon nanotube film in the heating element 10.

Figure 3:
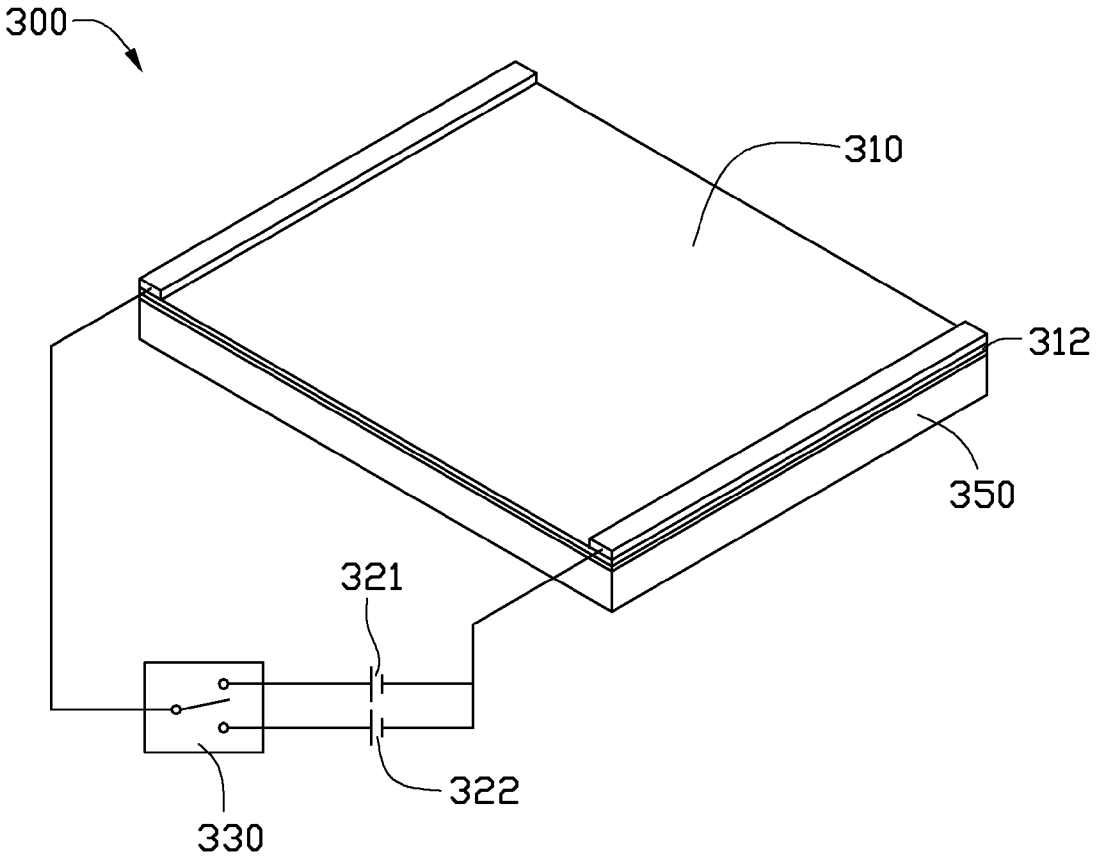
FIG. 3 is a schematic view of a third embodiment of a defogging device with carbon nanotube films.

FIG. 3 shows another embodiment of a carbon nanotube film defogging device 300 to substantially reduce fog on a surface of a substrate 350, comprising a heating element 310, a first power unit 321, a second power unit 322, and an automatic switch 330 connecting the heating element 310 to the first power unit 321 and the second power unit 322. The heating element 310 comprises at least one layer of carbon nanotube film 312. The carbon nanotube film 312 comprises a plurality of carbon nanotubes arranged in parallel.

The first power unit 321 and the second power unit 322 are independent of each other. In this embodiment, the first power unit 321 is a primary power to provide power to the heating element 310, and the second power unit 322 is a secondary power to provide power to the heating element 310 when the first power unit 321 malfunctions. For example, the first power unit 321 can be powered by wind energy, and the second power unit 322 can be a regular electrochemical battery, such as a dry cell, a wet cell or other electrolyte batteries. In such an application, the defogging device 300 can be attached to a car window or a rearview mirror of a car, which is often exposed to a windy environment. When the car is activated, wind provides power to the heating element 310, which transforms electrical energy into heat to evaporate fog on the window or the rearview mirror.

In another application, the first power unit 321 can be powered by wind energy and second power unit 322 by solar energy. In such an application, the carbon nanotube film defogging device 300 can be attached to exterior windows of a building, and the first power unit 321 and the second power unit 322 can provide power to the heating element 310 alternatively when wind blows or when the sun shines. Furthermore, a small windmill can be provided outside the window to enhance the wind power provided to the heating element 310.

The automatic power switch 330 can switch connections to the second power unit 322 when the voltage or the current of the power unit 321 falls below a predetermined voltage value or current value. The predetermined voltage value can be determined according to different situations of applying the defogging device with carbon nanotube films.

It is understandable that the carbon nanotube film of the defogging device disclosed by the present application is not limited to be formed by super-aligned carbon nanotube arrays, and also can be formed by other carbon nanotube films with high electrical conductivity. Furthermore, the defogging device with carbon nanotube film disclosed by the present application also can be connected to more than two powers supplies.

The defogging device with carbon nanotube films disclosed by the present application evaporates fog on a surface by utilizing a nanotube film connected to a power unit to transform electricity to heat effectively. Furthermore, the carbon nanotube film of the defogging device can be cut to fit the size and the shape of the substrate. The first and second power units can be switched automatically according to the environmental conditions to save electricity provided to the defogging device.

It is to be understood that the described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A defogging device for reducing fog on a surface of a substrate, comprising:

a heating element attached to the surface of the substrate, the heating element comprising at least one carbon nanotube film, the at least one carbon nanotube film comprising multiple carbon nanotubes arranged substantially parallel to each other;

a first power unit;

a second power unit;

a switch connected to the heating element and to the first and second power units;

the switch automatically switching connection to the second power unit to provide electricity to the heating element when a voltage or a current of the first power unit falls below a predetermined value.

2. The defogging device of claim 1, wherein the heating element further comprises at least two carbon nanotube films, and wherein carbon nanotubes in two adjacent carbon nanotube films of the at least two carbon nanotube films are perpendicular to each other.

3. The defogging device of claim 1, wherein the first power unit is a primary power supply, and the second power unit is a secondary power supply.

4. The defogging device of claim 1, wherein the first power unit is powered by wind energy, and the second power unit is a battery.

5. The defogging device of claim 1, wherein the first power unit is powered by wind energy, and the second power unit is powered by solar energy.

6. A defogging device, comprising:

a heating element, comprising at least one carbon nanotube film, the at least one carbon nanotube film comprising a plurality of carbon nanotubes arranged substantially parallel to each other;

a primary power supply;

a secondary power supply; and a switch connected to the heating element and to the primary and secondary power supplies, the switch configured to enable the secondary power supply to provide power to the heating element in response to the primary power supply malfunctioning.

7. The defogging device of claim 6, wherein the primary power supply is malfunctioning when a voltage or a current of the primary power supply falls below a predetermined value.

8. The defogging device of claim 7, wherein the heating element further comprises at least two carbon nanotube films, and carbon nanotubes in two adjacent carbon nanotube films of the at least two carbon nanotube films are perpendicular to each other.

9. The defogging device of claim 8, wherein the primary power supply is powered by wind energy, and the secondary power supply is a battery.

10. The defogging device of claim 8, wherein the primary power supply is powered by wind energy, and the secondary power supply is powered by solar energy.

11. An apparatus, comprising:

a substrate; and a defogging device attached to a surface of the substrate, the defogging device comprising:

a heating element comprising at least one carbon nanotube film, the at least one carbon nanotube film comprising a plurality of carbon nanotubes arranged substantially parallel to each other;

a primary power supply;

a secondary power supply; and a switch connected to the heating element and to the primary and secondary power supplies, the switch being configured to enable the secondary power supply to provide power to the heating element in response to the primary power supply malfunctioning.

12. The apparatus of claim 11, wherein the primary power supply is malfunctioning when a voltage or a current of the primary power supply falls below a predetermined value.

13. The apparatus of claim 12, wherein the heating element further comprises at least two carbon nanotube films, and carbon nanotubes in two adjacent carbon nanotube films of the at least two carbon nanotube films are perpendicular to each other.

14. The apparatus of claim 13, wherein the heating element is attached to the surface of the substrate by adhesive applied on a periphery of the surface of the substrate.

15. The apparatus of claim 14, wherein the primary power supply is powered by wind energy, and the secondary power supply is a battery.

16. The apparatus of claim 15, wherein the substrate is a car window or a rearview mirror of a car.

17. The apparatus of claim 14, wherein the primary power supply is powered by wind energy, and the secondary power supply is powered by solar energy.

18. The apparatus of claim 17, wherein the substrate is an exterior window of a building.

19. The apparatus of claim 18, further comprising a windmill provided outside the window, the windmill configured to enhance wind power provided to the heating element.

* * * * *